US011695219B2

(12) United States Patent
Govoni et al.

(10) Patent No.: US 11,695,219 B2
(45) Date of Patent: Jul. 4, 2023

(54) BROADBAND STACKED PATCH ANTENNA ARRAY

(71) Applicant: U.S. Army DEVCOM Army Research Laboratory, Adelphi, MD (US)

(72) Inventors: Mark A. Govoni, Abingdon, MD (US); Seth A. McCormick, Arlington, VA (US)

(73) Assignee: America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/322,317

(22) Filed: May 17, 2021

(65) Prior Publication Data

US 2022/0368028 A1 Nov. 17, 2022

(51) Int. Cl.
*H01Q 21/06* (2006.01)
*H01Q 1/42* (2006.01)
(Continued)

(52) U.S. Cl.
CPC ..... *H01Q 21/065* (2013.01); *H01Q 1/38* (2013.01); *H01Q 1/422* (2013.01); *H01Q 9/0414* (2013.01)

(58) Field of Classification Search
CPC ..... H01Q 21/065; H01Q 1/38; H01Q 1/422; H01Q 9/0414
See application file for complete search history.

(56) References Cited

U.S. PATENT DOCUMENTS 6,317,084 B1 * 11/2001 Chen ..... H01Q 1/38 343/700 MS
9,184,504 B2 11/2015 Zhang
(Continued)

OTHER PUBLICATIONS

F. Rostan, E. Heidrich and W. Wiesbeck, "Design of aperture-coupled patch antenna arrays with multiple dielectric layers," 1993 23rd European Microwave Conference, 1993, pp. 917-919, doi: 10.1109/EUMA.1993.336749. (Year: 1993).*
(Continued)

*Primary Examiner* — David E Lotter
(74) *Attorney, Agent, or Firm* — Eric B. Compton

(57) ABSTRACT

A stacked patch antenna array includes: a conductive ground plane configured to connect to a plurality of electrical transmission lines for transmitting and/or receiving electrical signals; a driven layer adjacent to the conductive ground plane formed of a dielectric material and comprising a plurality of first resonant circular patches, each electrically connecting to a respective electrical transmission line such that a received electrical signal excites and generates an electromagnetic signal and/or a received electromagnetic signal excites and generates an electrical signal; an electrically insulating spacer adjacent to the driven layer; and a coupled layer adjacent to the electrically insulating spacer formed of a dielectric material and comprising a plurality of second resonant circular patches which are symmetrically positioned with respect to the first circular resonant patches of the driven layer and excited by the electromagnetic waves generated by the first resonant circular patches, wherein the electrically insulating spacer electrically separates the driven layer and the coupled layer having a thickness such that the resonances of the first and second resonant circular patches constructively combine.

14 Claims, 7 Drawing Sheets

SIDE VIEW (UNASSEMBLED)

(51) Int. Cl.
*H01Q 1/38* (2006.01)
*H01Q 9/04* (2006.01)

(56) References Cited

U.S. PATENT DOCUMENTS

| | | | | |
|---|---|---|---|---|
| 10,347,991 | B2 | 7/2019 | Tatarnikov et al. | |
| 2011/0199279 | A1* | 8/2011 | Shen | H01Q 9/0414 343/700 MS |
| 2015/0084814 | A1* | 3/2015 | Rojanski | H01Q 9/0414 342/368 |
| 2017/0170568 | A1* | 6/2017 | Ammann | H01Q 1/20 |
| 2019/0379134 | A1* | 12/2019 | Paulotto | H01Q 21/062 |

OTHER PUBLICATIONS

P. Hannan, "Optimum Feeds for All Three Modes of a Monopulse Antenna I: Theory," IRE Trans. On Antennas and Propagation, vol. 9, Issue 5, 1961, pp. 444-454.
P. Hannan, "Optimum Feeds for All Three Modes of a Monopulse Antenna II: Practice," vol. 9, Issue 5, 1961, pp. 454 461.
H. Wheeler, "Antenna Beam Patterns Which Retain Shape with Defocusing," IRE Trans. On Antennas and Propagation, vol. 10, Issue 5, 1962, pp. 573-580.
Declaration regarding ARL-TR-9023 (dated May 19, 2021).

* cited by examiner

SIDE VIEW (ASSEMBLED)

SIDE VIEW (UNASSEMBLED)

TOP VIEW (PROJECTED, TRANSPARENT)

DRIVEN LAYER 20

COUPLED LAYER 40

E-plane (φ = 0)

H-plane (φ = 90)

E-plane (measured)

E-plane (simulated)

H-plane (measured)

H-plane (simulated)

$S_{11}$ reflection coefficient

Transmittance

BROADBAND STACKED PATCH ANTENNA ARRAY

GOVERNMENTAL INTEREST

The invention described herein may be manufactured, used and licensed by or for the U.S. Government.

BACKGROUND

Field

The field of the invention relates to antenna technology, and more particularly to, broadband stacked patch antenna arrays.

Description of Related Art

Existing front end antenna sensors for passive detection are narrowband (typically, low impedance bandwidth, e.g., 2-10%), lack configurability of their radiation pattern in terms of forming sum and difference patterns, and are not compact. As such, they can only provide coarse pointing accuracies which are not conducive to high precision applications. More, they are quite expensive to build. Thus, improvements are desired.

SUMMARY

The present invention provides stacked patch antenna arrays which are broadband, cost efficient, scalable, compact and highly accurate.

According to embodiments, a stacked patch antenna array may include: a conductive ground plane configured to connect to a plurality of electrical transmission lines for transmitting and/or receiving electrical signals; a driven layer adjacent to the conductive ground plane formed of a dielectric material and comprising a plurality of first resonant circular patches, each electrically connecting to a respective electrical transmission line such that a received electrical signal excites and generates an electromagnetic signal and/or a received electromagnetic signal excites and generates an electrical signal; an electrically insulating spacer adjacent to the driven layer; and a coupled layer adjacent to the electrically insulating spacer formed of a dielectric material and comprising a plurality of second resonant circular patches which are symmetrically positioned with respect to the first circular resonant patches of the driven layer and excited by the electromagnetic waves generated by the first resonant circular patches, wherein the electrically insulating spacer electrically separates the driven layer and the coupled layer having a thickness such that the resonances of the first and second resonant circular patches constructively combine.

The conductive ground plane may include a plurality of electrical ports or connectors which respectively connect to the electrical transmission lines. The connectors may comprise: SubMiniature version A (SMA) coaxial connectors, SubMiniature version B (SMB) coaxial connectors, SubMiniature version C (SMC) coaxial connectors, or micro coaxial connectors (MCX), for instance.

The first and second resonant circular patches may be formed of an electrically conductive metal or material. They might be formed of copper or copper alloy, for instance. There may be 2, 3 or 4 first resonant circular patches on the driven layer and a corresponding number of second resonant circular patches on the coupled layer. The second resonant circular patches may have a diameter larger than the first resonant circular patches.

The electrically insulating spacer may have a dielectric constant between about 1.0-1.1 so as to closely approximate air. For comparison sake, air has a dielectric constant c of 1.00059 at 1 atm and 1.0548 at 100 atm. It may be formed of a foam material, for instance.

The conductive ground plane, driven layer, electrically insulating spacer and coupled layer are attached together. They might be attached together with glue or adhesive.

Each of the conductive ground plane, the driven layer, the electrically insulating spacer and the coupled layer may further include one or more location holes for which a wire or a pin is fed through the locations holes to align them as they are joined and/or compressed together, and after their joining and/or compression, the wire or the pin is removed. The location holes may be later be plugged with similar material as the particular base substrate.

In some embodiments and implementations, the stacked patch antenna may be configured for operation between about 8-10.5 GHz. This generally corresponds to the X-band in the electromagnetic radiation spectrum. The stacked patch antenna array may be configured to have an impedance bandwidth of at least 20%.

A method of using the stacked patch antenna array may include: providing electrical signals comprising sum patterns, two orthogonal difference patterns, and/or individual element patterns.

These and other embodiments of the invention are described in more detail, below.

DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

FIG. 1A shows a side view of the stacked patch antenna in an assembled state and FIG. 1B shows an exploded side view of the stacked patch antenna array in an unassembled state.

FIGS. 6A-6C are simulated patterns for the stacked patch antenna array built by the inventors at 10 GHz, wherein FIG. 6A shows the 3-D antenna pattern, FIG. 6B shows the E-plane and FIG. 6C shows the H-plane.

FIG. 7A and FIG. 7B show the E-plane, for measured and simulated data, respectively, and FIG. 7C and FIG. 7D show the H-plane, for measured and simulated data, respectively.

FIG. 8A is for the $S_{11}$ reflection coefficient, and FIG. 8B is for transmittance.

Figure 1A:
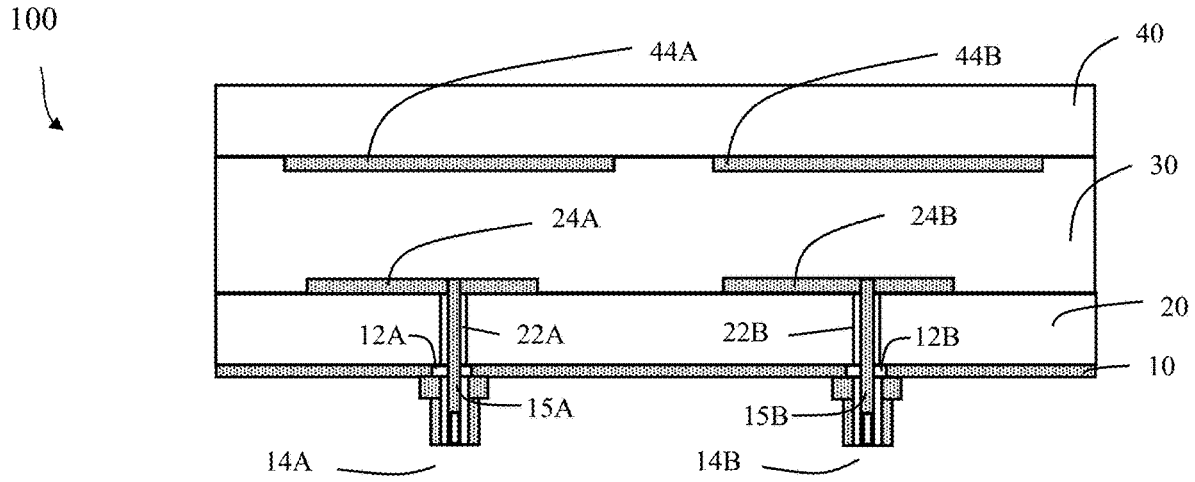
FIGS. 1A and 1B are schematic illustrations of a stacked patch antenna array and its constituent parts according to an embodiment, where

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

The present invention provides stacked patch antenna arrays. They are broadband, cost efficient, scalable, compact and highly accurate. The stacked patch antenna arrays have a multi-layered construction enabling its broadband function. They may be judiciously designed and constructed using conventional and standard-sized substrate materials to meet the need for a radiation pattern flexible, broadband, high frequency, and cost effective passive detector front end. The antenna array can be readily scaled to different center frequencies while maintaining a high bandwidth ratio (e.g., 3:1 regardless the center frequency), thereby remaining broadband at lower or higher frequencies. The stacked patch antenna arrays may be well impedance matched over their bandwidth making them capable to be used in a transmit mode effectively and with the same radiation pattern capabilities as in receive mode. They may be broadband with at minimum a 20% impedance bandwidth making it broadband and the capabilities to produce sum, two orthogonal difference, and individual element patterns in a compact package that can yield pointing accuracies well beyond the physical limits of an antenna of similar size.

Figure 1B:
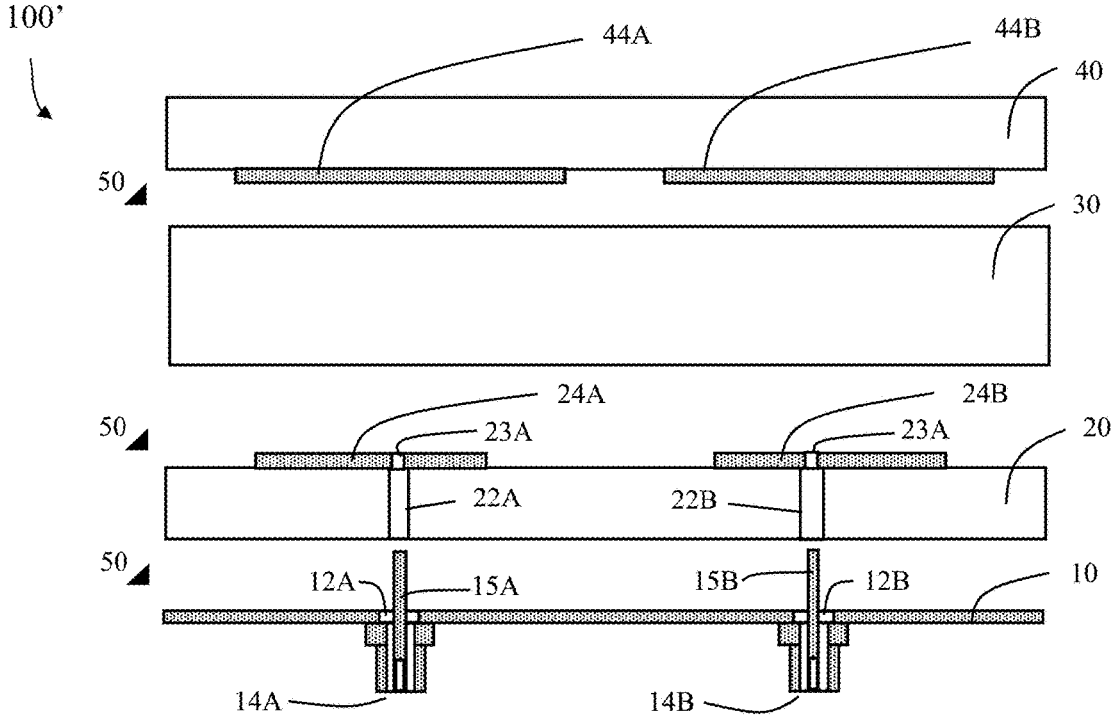

FIGS. 1A and 1B are schematic illustrations of a stacked patch antenna array and its constituent parts according to an embodiment. FIG. 1A shows a side view of the stacked patch antenna array (100) in an assembled state. FIG. 1B shows an exploded side view of the stacked patch antenna array (100') in an unassembled state.

The stacked patch antenna array (100) is a multi-layer structure, formed of four main substrates. These include a conductive ground plane (10), a driven layer (20), an electrically insulating spacer (30) and a coupled layer (40). The antenna array (100) as shown is circular in cross-section.

Each substrate's thickness may be a standard size, thereby making fabrication more cost effective than a custom substrate. Although, custom sizes are certainly possible and may be more advantageous for some applications. For ease of understanding, electrically conductive elements and portions have been shaded. Non-conductive elements have not.

First, the conductive ground plane (10) may be formed of any generally electrically conductive material. Non-limiting examples are metals, such as copper or copper alloy which are relatively inexpensive. Although, others metals and conductive materials are certainly possible. Through holes (12A, 12B) are formed in the ground plane (10). They may be drilled, punched or stamped, for instance.

Attached to the ground plane (10) are connectors (14A, 14B). They may be soldered, brazed, tack-welded and/or otherwise attached, such as mechanically, with crimping or using bendable tangs. As shown, the connectors (14A, 14B) are SubMiniature version A (SMA) coaxial type connector connectors. Although, it will be appreciated that various other types of connectors may be used, such as SubMiniature version B (SMB), SubMiniature version C (SMC), micro coaxial connector (MCX), etc. They would be dimensioned are properly scaled according the intended operation wavelength of the RF signals. The SMA connectors (14A, 14B) connect to standard co-axial cables (not shown). More particularly, and as is conventional, each of the SMA connector (14A, 14B) shown is formed of an outer external shield or ferrule and a central female pin connector formed of electrically conductive material, such as copper or copper alloy, which are separated by dielectric spacer. The central female pin connector engages with a corresponding center male pin connector of a standard co-axial cables (not shown). The rear of the female pin connector connects to a conductive transmission line (15A, 15B). External threading may be provided on the external outer surface of the ferrule or shield of the SMA connectors (14A, 14B) to engage with similarly threading of the standard co-axial cables (not shown). The co-axial cables connect to an RF trans-receiver (not shown) for generating and/or receiving electrical signals corresponding to radio-frequency (RF) signals transmitted or received by the stacked patch antenna array (100).

Electrical signals comprising sum patterns, two orthogonal difference patterns, and/or individual element patterns may be provided. Such signal are well-known in the art. See, e.g., P. Hannan, "Optimum Feeds for All Three Modes of a Monopulse Antenna I: Theory," IRE Trans. On Antennas and Propagation, Vol. 9, Issue 5, 1961, pp. 444-454; P. Hannan, "Optimum Feeds for All Three Modes of a Monopulse Antenna II: Practice," Vol. 9, Issue 5, 1961, pp. 454-461; and H. Wheeler, "Antenna Beam Patterns Which Retain Shape with Defocusing," IRE Trans. On Antennas and Propagation, Vol. 10, Issue 5, 1962, pp. 573-580, herein incorporated by reference in their entities. These signals may be used to practice various embodiments of the invention. More particular, they will ultimately be feed from the SMA connectors (14A, 14B) via the conductive transmission line (15A, 15B) to the resonant circular patches (24A, 24B) of the driven layer (20) for generating RF signals.

Each of the though holes (12A, 12B) formed in the conductive ground plane (10) are slightly larger in diameter than its corresponding conductive transmission line (15A, 15B) so that it does not short to the outer shield or ferrule of the SMA connector (14A, 14B). The through holes (12A, 12B) are made preferably smaller than the SMA dielectric sheath (approximately half its radius) to further improve the impedance match. The conductive transmission line (15A, 15B) are preferably impedance-matched to the RF trans-receiver.

The next substrate, the driven layer (20), is connected the top of conductive ground plane (10). It may be formed of a suitable dielectric material. One non-limiting example is Kappa 438 material (dielectric constant, $\varepsilon$=4.38). The driven layer (20) includes a plurality of resonant circular patches (24A, 24B) equally spaced from the substrate center, formed opposite of the conductive ground plane (10). Patches (24A, 24B) may be conventional patch antennas. For instance, the circular patches (24A, 24B) may be formed of electrically conducive material suitable as an antenna patch. Various conductive metals may be used, such as copper or copper alloys as non-limiting examples.

Figure 3A:
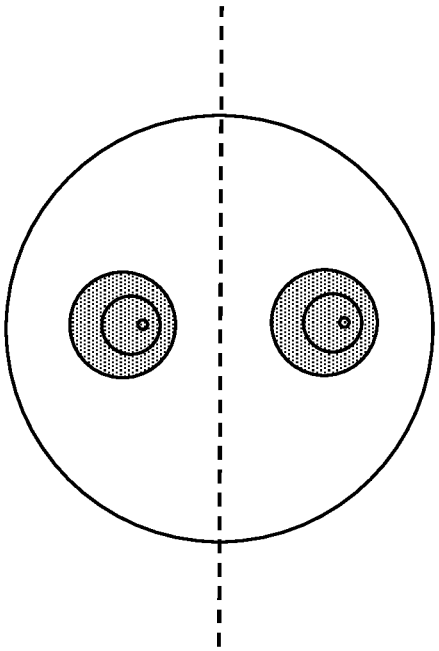
FIGS. 3A-3C show examples of a stacked patch antenna array configured for 2, 3 and 4 resonant circular patches on the driven layer and a corresponding number of resonant circular patches on the coupled layer, respectively, according to an embodiments.
Figure 3B:
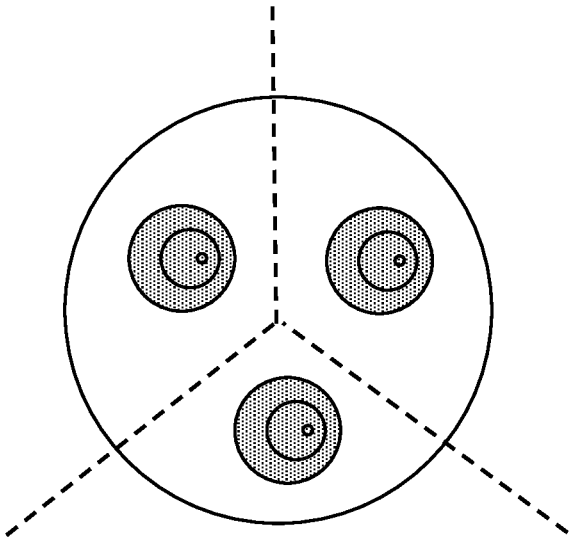
Figure 3C:
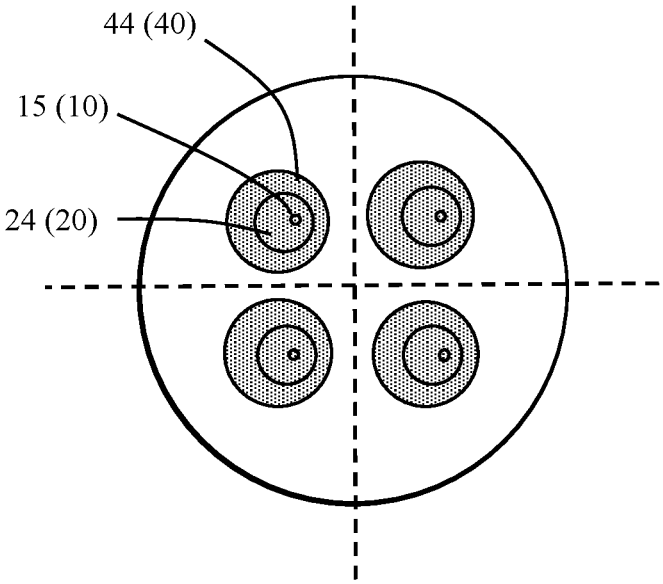

There may be 2, 3, or 4 of the resonant circular patches (24A, 24B) forming the antenna array depending on the configuration (see FIGS. 3A-3C). Additional patches might also be provided, although, surface spacing becomes a challenge for greater numbers. These may be referred to as first resonant circular patches. Each of the resonant circular patches (24A, 24B) has a corresponding SMA connector (14A, 14B) on the conductive ground plane (10). Through holes (22A, 22B) are formed in the driven layer (20) to receive one of the conductive transmission lines (15A, 15B) of the SMA connectors (14A, 14B). They may be drilled, punched or stamped, for instance. The though holes (22A, 22B) may be slightly larger in diameter than the lines (15A, 15B) to permit relative motion for ease of assembly. A small hole (23A, 23B) is included in each of the resonant circular patches (24A, 24B) for engaging with the terminal or end portion of one of the conductive transmission lines (15A, 15B). The conductive transmission line (15A, 15B) may be soldered to the resonant circular patches (24A, 24B) around the small holes (23A, 23B).

Connected to top of the driven layer (20), the third substrate, is the electrically insulating spacer (30). It could have a dielectric constant between about 1.0-1.1 so as to closely approximate air. For comparison, air has a dielectric constant ε of 1.00059 at 1 atm and 1.0548 at 100 atm. The electrically insulating spacer may be formed of a foam, for instance. One non-limiting material for the electrically insulating spacer (30) is formed of a general purpose foam. One example is a low-density polyurethane foam (dielectric constant, ε=1.04). Various other construction and packing foams can also be used. The electrically insulating spacer (30) provides physical stand off or separation between the set of resonant patches (24) on the driven layer (20) and the set of resonant patches (44A, 44B) on the coupled layer (40). Its thickness is preferably made optimal to balance the antenna impedance bandwidth and its broadside realized gain. The result is an impedance bandwidth greater than those layers individually.

When the stacked patch antenna array (100) is assembled, the spacer (30) can deform slightly (e.g., crush or compact) to accommodate the two sets of circular resonator patches pressing into both its sides. Alternatively, the material of the spacer (30) in the vicinity of both sets of resonant patches (24A, 24B and 44A, 44B) might be removed to accommodate them without the need for deformation.

The fourth substrate, the coupled layer (40), is connected to the top of the electrically insulating spacer (30). This layer may be formed of a suitable dielectric material. One non-limiting example material for the coupled layer (40) is Duroid 5880 material (dielectric constant, ε=2.33). On the bottom surface of the coupled layer (40) are resonant circular patches (44A, 44B). These may be referred to as second resonant circular patches. They may be formed of an electrically conductive metal similar to the resonant circular patches (24) on the driven layer (20). There may be 2, 3, or 4 of the resonant circular patches (44A, 44B) on the coupled layer (40) depending on the configuration (see FIGS. 3A-3C), the number corresponding to the same number of resonant circular patches (24A, 24B) on the driven layer (20). Additional patches might also be provided, although, surface spacing becomes a challenge for greater numbers. Resonator circular patches (44A, 44B) may be conventional patch antennas. For instance, the resonator circular patches (44A, 44B) may be formed of electrically conducive material suitable as an antenna patch. Various conductive metals may be used, such as copper or copper alloys as non-limiting examples.

The resonant circular patches (44A, 44B) of the coupled layer (40) may have a diameter larger than the resonant circular patches (24A, 24B) on the driven layer (20). The center axes of the resonant patches (44A, 44B) generally align to the center axes of the driven patches (24A, 24B).

The top surface of the coupled layer (40) can also serve as a pseudo-radome to protect the stacked patch antenna array. For instance, a Duroid substrate is very durable. The assembled stacked patch antenna array (100) may be further placed or held in a housing (not shown) for added protection if desired.

During operation, the stacked patch antenna array (100) allows for the first resonant circular patches (24A, 24B) of the driven layer (20) to be excited by an electromagnetic wave that then couples with the second resonant circular patches (44A, 44B) on the coupled layer (40). The electrically insulating spacer (30) separates these two types of patches by an amount necessary for the two layers' resonances to constructively add or sum and thereby achieve the desired broadband response.

The four substrates (10, 20, 30, 40) may be attached with suitable glue or adhesive applied by a suitable applicator (50) to form the stacked patch antenna array (100). The glue or adhesive could be a spray adhesive, for instance. One non-limiting example is 3M Spray Adhesive 90-24. Alternatively, the glue or adhesive might be provided by means of be a double sided tape. One non-limiting example is 3M adhesive transfer tape 9472FL. The glue or adhesive may be judiciously applied with the applicator (50) to the top surfaces of the first three substrates. For instance, applicator (50) could be a spray applicator or a doubled sided tape dispenser for the aforementioned examples.

Figures 2A, 2B:
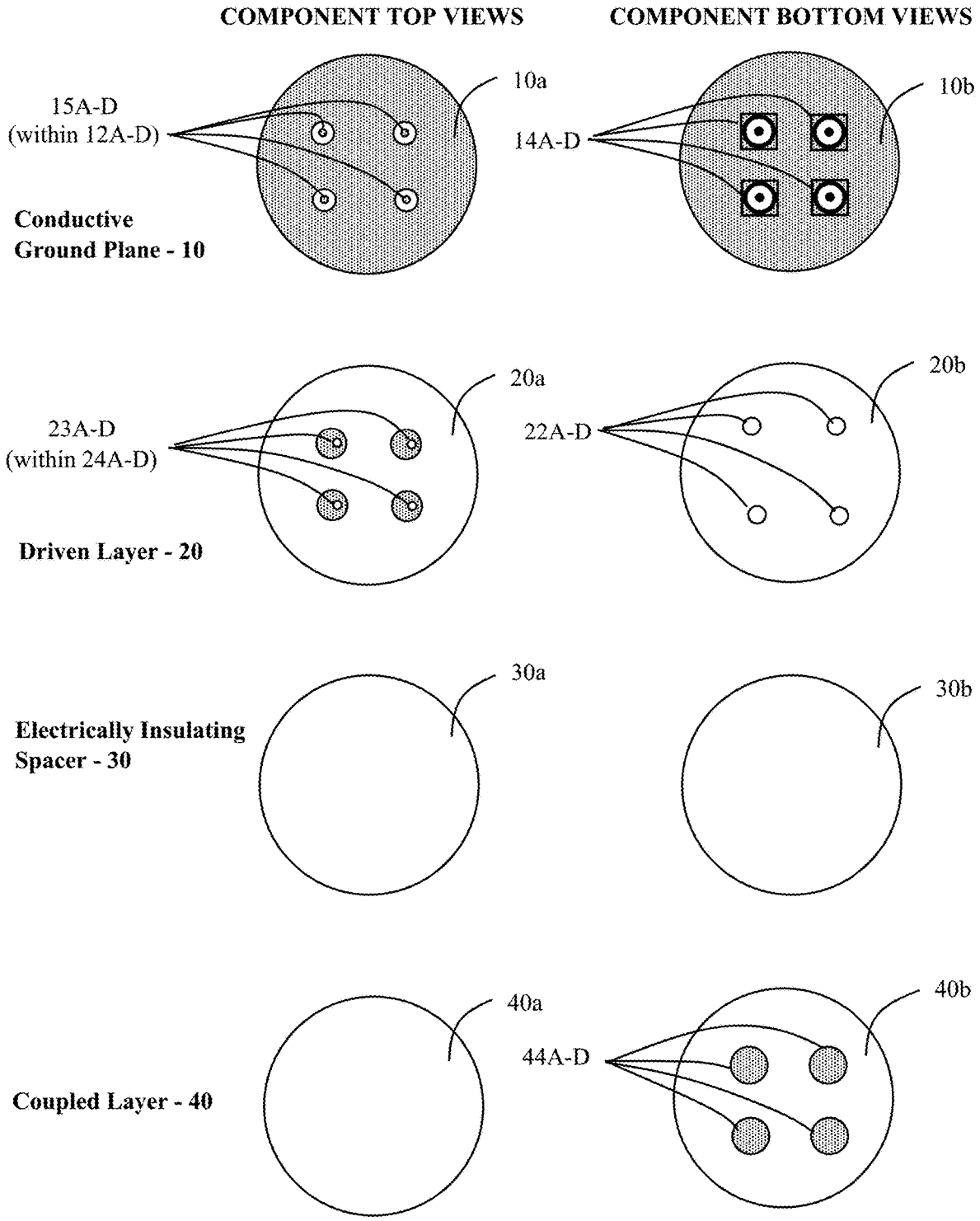
FIGS. 2A and 2B show more detailed views of the top and bottom surfaces of the conductive ground plane, the driven layer, the electrically insulating spacer, and the coupled layer respectively, for the stacked patch antenna array according to an embodiment.

FIGS. 2A and 2B show more detailed views of the top and bottom surfaces of the conductive ground plane (10*a*, 10*b*), the driven layer (20*a*, 20*b*), the electrically insulating spacer (30*a*, 30*b*), and the coupled layer (40*a*, 40*b*), respectively, for the stacked patch antenna array of FIGS. 1A and 1B. In these figures, there are four SMA connectors (14A, 14B, 14C, 14D), four circular resonant patches (24A, 24B, 24C, 24D) on the driven layer (20), and four circular resonant patches (44A, 44B, 44C, 44D) on the coupled layer (40).

FIGS. 3A-3C show examples of a stacked patch antenna array configured for 2, 3 and 4 resonant circular patches (24) on the driven layer (20) and a corresponding number of resonant circular patches (44) on the coupled layer (40), respectively. The views are from the top projected assuming the material are transparent (for ease of understanding). The figure labels are included for one set of overlapping elements in FIG. 3C, but would be similar for other sets of overlapping elements in that figure as well as for FIGS. 3A and 3B. The two sets of resonator patches (24) and (44) are symmetrical located or positioned about the top surfaces. The conductive transmission lines (15) connect the former patches (24) of the driven layer (20) to the SMA connectors (14) on the conductive ground plane (10). More particularly, the center-to-center distance of each of the resonant patches is equal; hence, the dotted cutting planes in-between pairs of patches. The patches (24) and (44) are equidistant from the cutting planes as depicted in the figures.

Figure 4A:
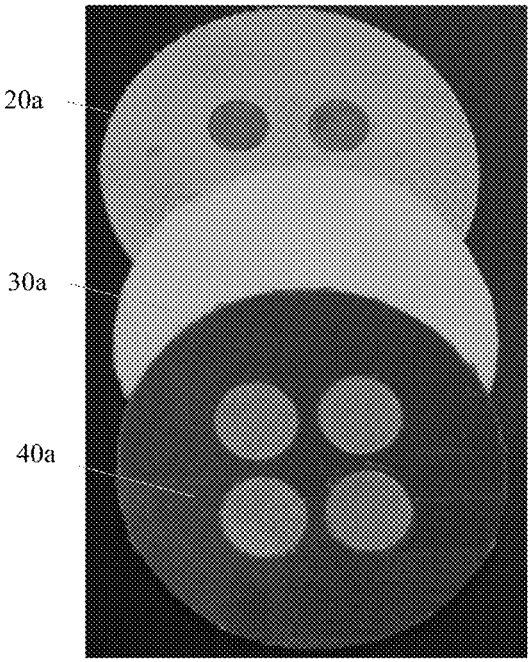
FIGS. 4A and 4B are photographs showing the various components of a stacked patch antenna array configured with 4 resonant circular patches on the driven layer and a corresponding number of second resonant circular patches on the coupled layer, before assembly, according to one particular embodiment built and tested by the inventors.
Figure 4B:
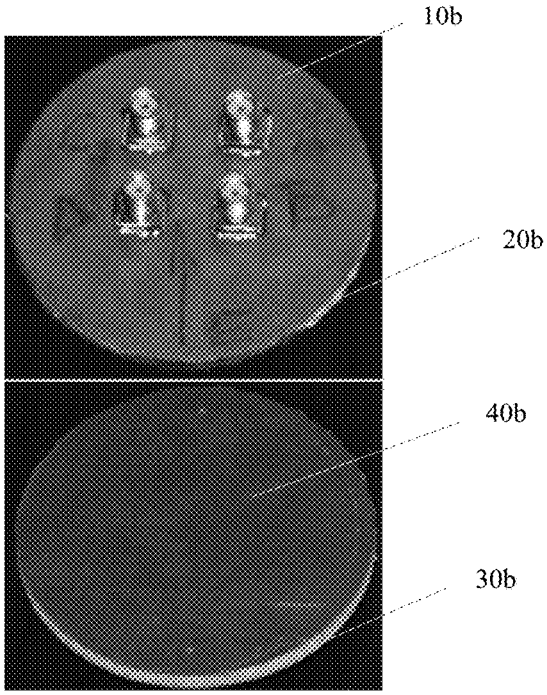

FIGS. 4A and 4B are photographs showing the various components of a stacked patch antenna array configured with four resonant circular patches on the driven layer and four resonant circular patches on the coupled layer, before assembly, according to one particular embodiment built and tested by the inventors.

The outer diameters of the substrates (i.e., 10, 20, 30, 40) of the stacked patch antenna array (100) will generally be the same. Here, they are all 50.000 mm (1.969 inches) in diameter. Their thickness vary though.

The conductive ground plane (10) here is formed of copper. It has four SMA connectors (14) attached to its bottom surface (10*b*). The connectors (14) are labelled A, B, C and D in the photograph of FIG. 4B. And the electric field (E field) direction is labelled E in that photograph. The conductive ground plane (10) here is 40 microns (micrometers) thick.

The driven layer (20) is formed of the dielectric material Kappa 438 (dielectric constant, ε=4.38). It has a thickness of 1.016 mm. Each of the four circular resonator patches has a diameter of 9.050 mm and a thickness of 20 μm.

The electrically insulating spacer (30) is formed of a general purpose, low-density, packing foam (dielectric constant, ε=1.04) made from polyurethane. It has a thickness of 2.388 mm. The foam spacer provides physical stand off or separation between the first resonant circular patches (24) on the driven layer (20) and the second resonant circular patches (44) on the coupled layer (40). The result is an impedance bandwidth greater than those layers individually. When the stacked patch antenna array (100) is assembled, the spacer (30) can deform slightly (e.g., crush or compact) to accommodate the two sets of circular resonator patches (24 and 44) pressing into both its sides.

The coupled layer (40) is formed of Duroid 5880 (dielectric constant, ε=2.33). It has a thickness of 0.381 mm. Each of the four circular resonator patches (44) has a diameter of 12.416 mm and a thickness of 20 μm. In the photograph of FIG. 4A, the four copper patches (44) of the coupled layer (40) are shown face up, but would be positioned face down towards the copper patches (24) in the driven layer (20) as in FIG. 1A.

Figure 5A:
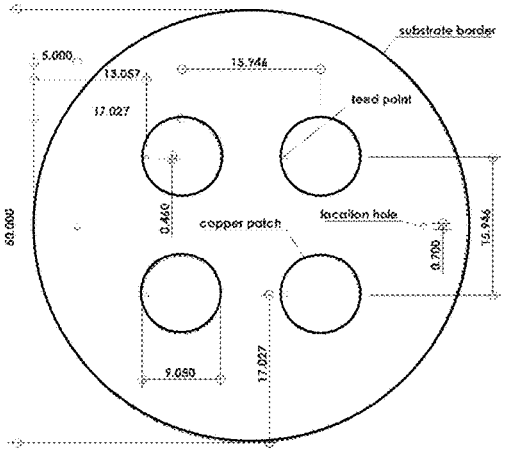
FIGS. 5A and 5B are detailed schematics of the driven layer and the coupler layer, respectively, according to one particular embodiment built and tested by the inventors.
Figure 5B:
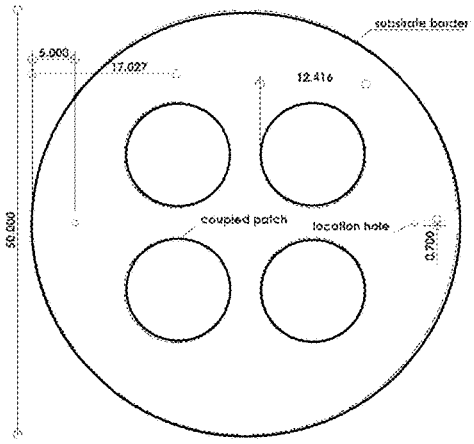

FIGS. 5A and 5B are detailed schematics of the driven layer (20) and the coupler layer (40), respectively, according to one particular embodiment built by the inventors. They show the layout and various dimensions of the elements.

Each of the circular resonant patches (24) of the driven layer (20) is 9.050 mm in diameter and 20 μm in thickness, whereas those in the circular resonant patches (44) or the coupled layer (40) are 12.416 mm in diameter and 20 μm in thickness. In both layers, all four patch centers are spaced from adjacent patch centers by 15.946 mm and are spaced 17.027 mm from the corresponding substrate border. The placement of the antenna feeds relative to each patch in the driven layer which may be conventional. The feed point locations are annotated in the figures for the driven layer (20).

A "location hole" feature is identified in these figures for the driven layer (20) and the coupled layer (40). Note, two of such holes are shown in these figures for the substrates. These small holes can be used for alignment in assembling the substrates (10, 20, 30, 40) of the stacked patch antenna array (100). A thin piece of wire or a pin is fed through the locations holes to align the substrates as are joined and/or compressed together. After their joining and/or compression, the wires or pins are removed. The location holes may be later be plugged or filled with similar material as the particular base substrate.

Figure 6A:
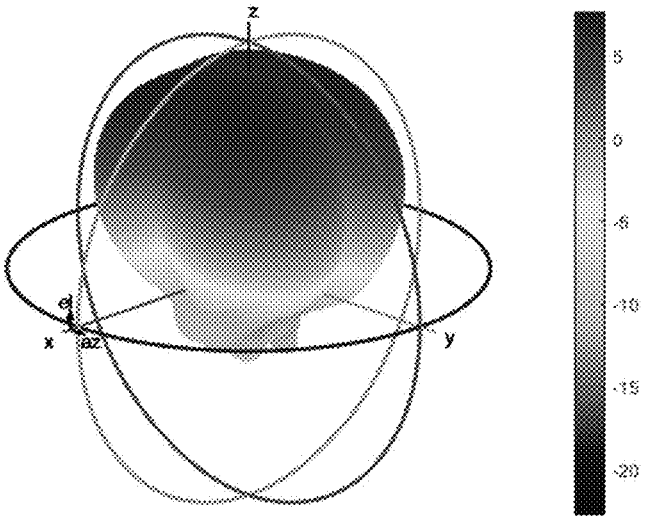
Figure 6B:
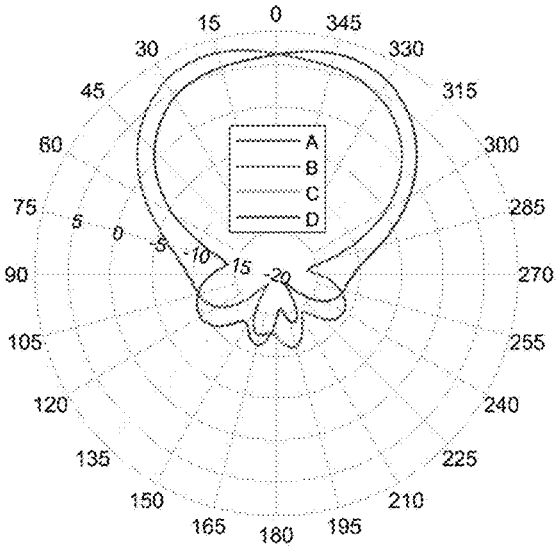
Figure 6C:
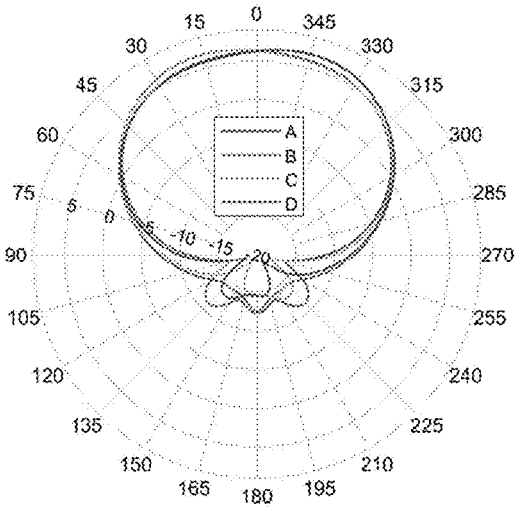

FIGS. 6A-6C are simulated patterns for the stacked patch antenna array for a twin antenna embodiment (similar to FIG. 3A) built and tested by the inventors at 10 GHz, wherein FIG. 6A shows the 3-D antenna pattern, FIG. 6B shows the E-plane (φ=0) and FIG. 6C shows the H-plane (φ=90). The stacked patch antenna array modelled functions as a compact front end to a four port receiver or transmitter in the first half of the X-microwave band (i.e., about 8-10.5 GHz). The individual ports of the array allow it to generate both sum and difference patterns in orthogonal planes as well as individual element patterns. As an example, the simulated three dimensional antenna radiation pattern shown in FIG. 6A combines all four antenna patterns into one thereby producing a sum pattern. The pattern is plotted in ISO conventional spherical coordinates (ρ, θ, ϕ), where ρ is the total gain, θ is the elevation angle, and φ is the azimuth angle. Shown in FIG. 6B and FIG. 6C are the individual simulated antenna patterns for the stacked patch antenna at 0 degree and 90 degree azimuth angles (i.e. principal planes), respectively. From the plots in these figures, the front-to-back ratios are greater than 15 dB on average, the peak gains at 0 degrees are 6.25 dBi, and the half power beamwidths (HPBWs) are approximately 46 degrees and 40 degrees in elevation and azimuth, respectively. The patterns demonstrate that the invention functions as a directional antenna as intended.

Figure 7A:
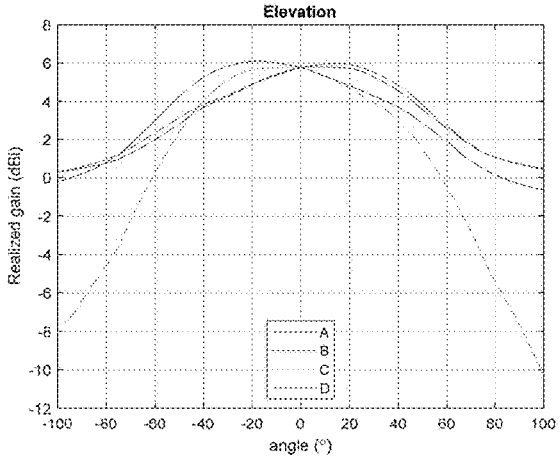
FIGS. 7A-7D are plots showing measured and simulated principal plane antenna patterns for the stacked patch antenna array built by the inventors at 10 GHz, where
Figure 7B:
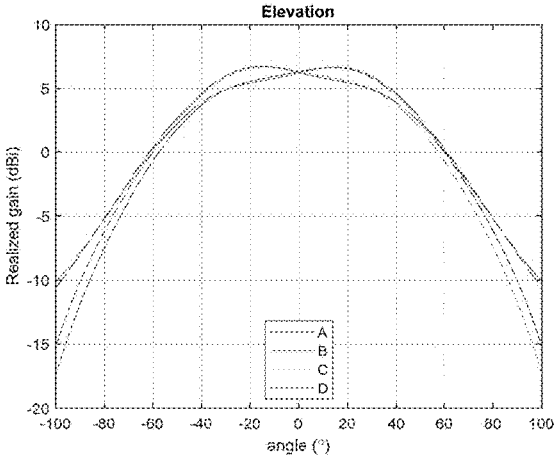
Figure 7C:
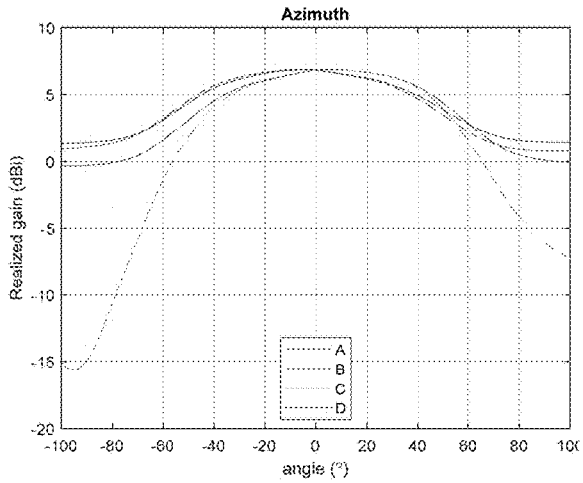
Figure 7D:
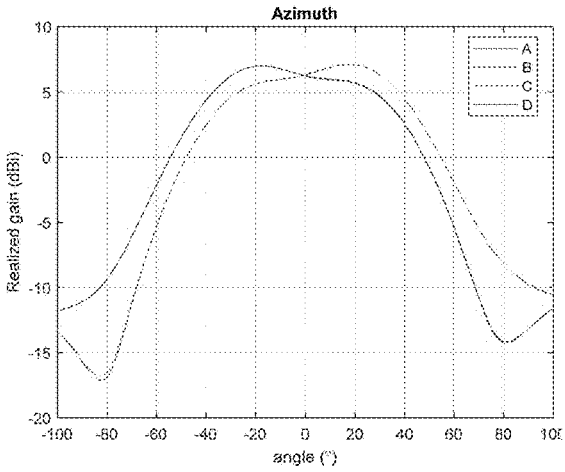

FIGS. 7A-7D are plots showing measured and simulated principal plane antenna patterns for the twin stacked patch antenna array built by the inventors at 10 GHz, where FIG. 7A and FIG. 7B show the E-plane, for measured and simulated data, respectively, and FIG. 7C and FIG. 7D show the H-plane, for measured and simulated data, respectively. The stacked patch antenna array was tested by measuring its radiation pattern using a NSI 2000 Pro v. 4.6.3 near-field range spherical scanner. The spherical scan capability captured the principal plane radiation patterns out to a far field angle of ±100 degrees. FIGS. 7A-7D show the measured and simulated principal plane patterns at 10 GHz. Despite having been measured against a calibrated standard, and then averaged and balanced in post-process; the individual patterns do not include corrections for all possible error sources present in the near field range. Despite this, the shape of the measured patterns in the ±60 degree region, where the measurements are most valid, shown in the plots are similar to the simulated pattern, which shows that the stacked patch antenna array functions as expected.

Figure 8A:
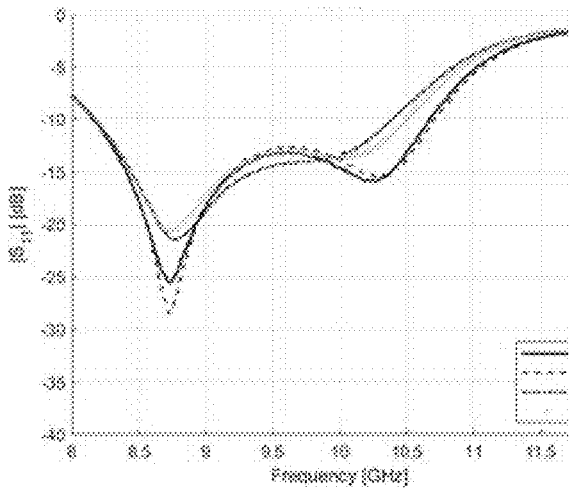
FIGS. 8A and 8B are plots showing the measured stacked patch antenna built by the inventors, where
Figure 8B:
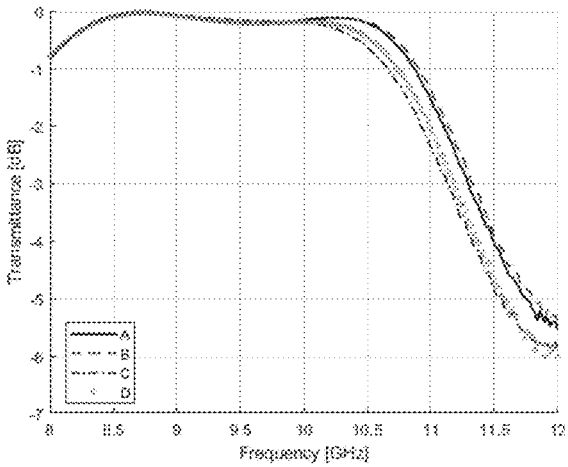

FIGS. 8A and 8B are plots showing the measured twin stacked patch antenna built by the inventors, where FIG. 8A is for the $S_{11}$ reflection coefficient, and FIG. 8B is for transmittance. The broadband function of the antenna array is demonstrated and verified by FIG. 8A which shows measured reflection coefficients for all four antenna ports for the fabricated antenna. The measured bandwidths in FIG. 8A are 2.5 (26.6%), 2.52 (27.0%), 2.2 (24.0%), and 2.3 GHz (25.0%) for ports A, B, C, and D respectively. FIG. 8B plots the transmittance versus frequency for each port. This parameter is calculated according to $(1-|S_{11}|^2)$, where $|S_{11}|$ is shown in decibels in FIG. 8A, which estimates the power transmitted into the antenna port and demonstrates that the antenna reflects little power from its ports over a broad bandwidth. A value of −3 dB infers that 50% of the source power is transmitted into the antenna port and a value of −0.5 dB infers 90% transmittance. The wideband nature of the antenna design is clearly shown, where frequency-dependent values of less than −8 dB for the $S_{11}$ magnitude (84% transmissivity) shown in FIG. 8A are exhibited for frequencies spanning 8-10.5 GHz. The transmittance corresponding to these same frequencies shown in FIG. 8B is relatively uniform. Because the antenna array is non-scanning, these results hold for all E-plane (elevation) and H-plane (azimuth) angles.

Figure 9:
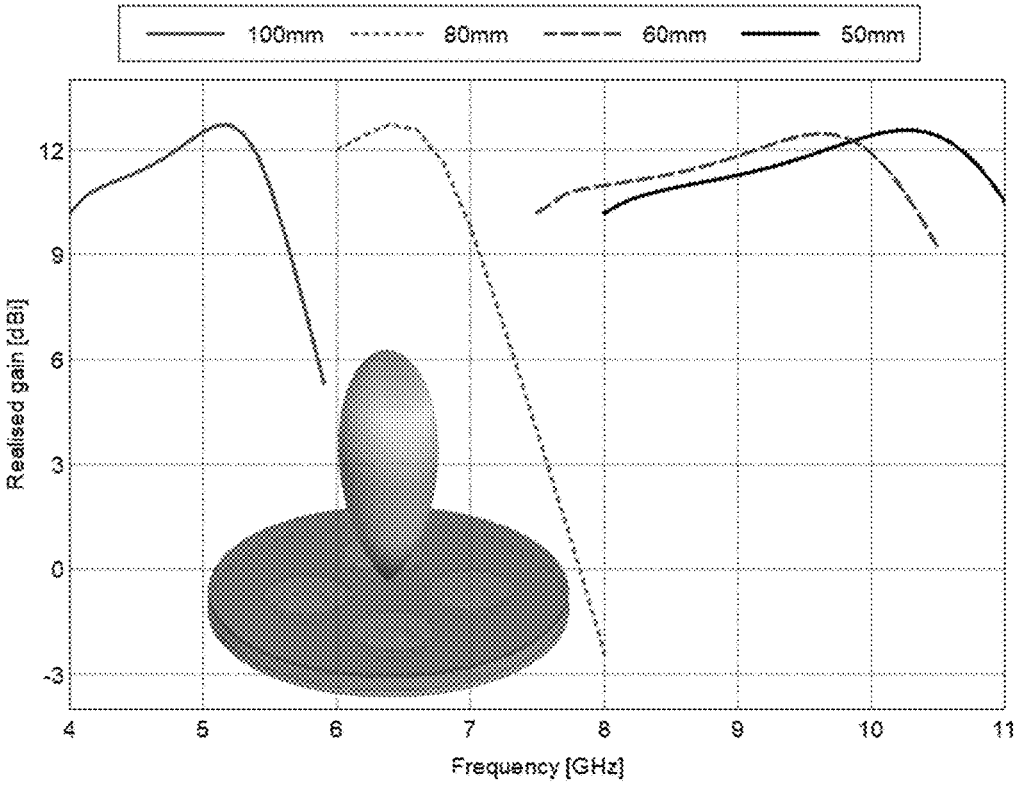
FIG. 9 is a plot showing the scalability of the stacked patch antenna array according to embodiments.

FIG. 9 is a plot showing the scalability of the stacked patch antenna array according to embodiments. It assumes an operational band (8-10.5 GHz) which is considered wideband at the 10 GHz design frequency, this type of antenna is still limited to functioning within a specific frequency range. Fortunately, this antenna is highly scalable by design and could be rescaled to accommodate different operational frequencies without sacrificing the fractional bandwidth (3:1) as the current design. As with all antennas, the impedance bandwidth is best defined in terms of a percentage, which if the relative relationships of all of the patch dimensions remains constant, will also remain constant as the antenna and its features are increased in size. The gain will also remain constant. Examples of varying antenna sizes and their corresponding gains and operational bands are shown here. However, as can be inferred by the gain bandwidth, while the fractional bandwidth is maintained, the instantaneous bandwidth measured in Hz contracts. Furthermore, there is a practical limit on the scale range that the antenna can be varied over as standard printed circuit board (PCB) substrates and fabrication precision are inherently limiting. With that said, the antenna can be linearly scaled over a sufficiently broad enough range to accommodate most payload delivering packages. Linear scalability means that each dimension is scaled by the same factor which is related to the scaling in frequency. For example, if you want to operate at a frequency that is a factor of 2 less than what this design was built for, then you increase all dimensions by a factor of 2.

The novel stacked patch antenna array technology disclosed herein may be used for the following non-limiting applications:

- Radiological Safety, i.e., to measure high power RF Radiation to determine personnel exclusion zones per 47 C.F.R. §§ 1.1307(b), 1.1310, 2.1091 and 2.1093.
- Transmitter Power Monitoring Regulation and Control Circuitry to monitor RF emissions and determine if corrections are sufficient (Automatic Gain Control) for emitters whose output level is regulated (e.g., 50,000 W AM Radio).
- Radar Detectors—to establish the presence of high power Radar emitters.
- Cellular Tower Output Monitoring to ensure stability of deployed cellular relay stations.
- Intentional/Unintentional Interference Detection to determine source and location of possible high power RF emitters.
- Hi-Fidelity Audio Systems to ensure received power levels are less than levels that cause distortion thus degrading the quality of the audio presented to the listener.
- Microwave Oven Leakage Indicators.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, and to describe the actual partial implementation in the laboratory of the system which was assembled using a combination of existing equipment and equipment that could be readily obtained by the inventors, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

We claim:

1. A stacked patch antenna array comprising:

a conductive ground plane configured to connect to a plurality of electrical transmission lines for transmitting and/or receiving electrical signals;

a driven layer adjacent to the conductive ground plane formed of a dielectric material and comprising a plurality of first resonant circular patches, each electrically connecting to a respective electrical transmission line such that a received electrical signal excites and generates an electromagnetic signal and/or a received electromagnetic signal excites and generates an electrical signal;

an electrically insulating spacer adjacent to the driven layer; and a coupled layer adjacent to the electrically insulating spacer formed of a dielectric material and comprising a plurality of second resonant circular patches which are symmetrically positioned with respect to the first circular resonant patches of the driven layer and excited by the electromagnetic waves generated by the first resonant circular patches, wherein the electrically insulating spacer electrically separates the driven layer and the coupled layer having a thickness such that the resonances of the first and second resonant circular patches constructively combine, and each of the conductive ground plane, the driven layer, the electrically insulating spacer and the coupled layer includes one or more location holes for which a wire or a pin is fed through the locations holes to align them as they are joined and/or compressed together, and after their joining and/or compression, the wire or the pin is removed.

2. The stacked patch antenna array of claim 1, wherein the conductive ground plane comprises a plurality of electrical ports or connectors which respectively connect to the electrical transmission lines.

3. The stacked patch antenna array of claim 1, wherein the connectors comprise: SubMiniature version A (SMA) coaxial connectors, SubMiniature version B (SMB) coaxial connectors, SubMiniature version C (SMC) coaxial connectors, or micro coaxial connectors (MCX).

4. The stacked patch antenna array of claim 1, wherein the first and second resonant circular patches are formed of an electrically conductive metal or material.

5. The stacked patch antenna array of claim 1, wherein there are 2, 3 or 4 first resonant circular patches on the driven layer and a corresponding number of second resonant circular patches on the coupled layer.

6. The stacked patch antenna array of claim 1, wherein the second resonant circular patches have a diameter larger than the first resonant circular patches.

7. The stacked patch antenna array of claim 1, wherein the electrically insulating spacer has a dielectric constant between about 1.0-1.1.

8. The stacked patch antenna array of claim 1, wherein the electrically insulating spacer is formed of a foam material.

9. The stacked patch antenna array of claim 1, wherein the conductive ground plane, the driven layer, the electrically insulating spacer and the coupled layer are attached together.

10. The stacked patch antenna array of claim 1, wherein the conductive ground plane, the driven layer, the electrically insulating spacer; and the coupled layer are attached together with glue or adhesive.

11. The stacked patch antenna array of claim 1, wherein the location holes are plugged or filled with similar material as the particular base substrate.

12. The stacked patch antenna array of claim 1, configured for operation between about 8-10.5 GHz.

13. The stacked patch antenna array of claim 1, configured to have an impedance bandwidth of at least 20%.

14. A method of using the stacked patch antenna array of claim 1 comprising:

providing electrical signals comprising sum patterns, two orthogonal difference patterns, and/or individual element patterns.

* * * * *